US006353286B1

(12) United States Patent
Talin et al.

(10) Patent No.: US 6,353,286 B1
(45) Date of Patent: Mar. 5, 2002

(54) FIELD EMISSION DISPLAY HAVING A MULTI-LAYERED BARRIER STRUCTURE

(75) Inventors: Albert Alec Talin, Scottsdale; Bernard F. Coll, Fountain Hills; Chenggang Xie, Phoenix; Yi Wei, Chandler; Troy A. Trottier, Mesa, all of AZ (US)

(73) Assignee: Motorola, Inc, Schaumburg, IL (US)

( * ) Notice: Subject to any disclaimer, the term of this patent is extended or adjusted under 35 U.S.C. 154(b) by 0 days.

(21) Appl. No.: 09/414,737

(22) Filed: Oct. 8, 1999

(51) Int. Cl.[7] ..... H01J 19/24
(52) U.S. Cl. ..... 313/496; 313/306
(58) Field of Search ..... 313/496, 495, 313/497, 306, 309, 336, 351, 489, 635

(56) References Cited

U.S. PATENT DOCUMENTS 4,041,316 A 8/1977 Todokoro et al. ..... 250/396 R
5,982,082 A 11/1999 Janning ..... 313/336
6,215,241 B1 * 4/2001 Haven et al. ..... 313/495

FOREIGN PATENT DOCUMENTS

FR 2760755 3/1998 ..... C09K/11/02
WO WO9963567 12/1999

* cited by examiner

*Primary Examiner*—Ashok Patel
(74) *Attorney, Agent, or Firm*—Kevin D. Wills; William E. Koch

(57) ABSTRACT

A field emission display (100) includes an electron emitter structure (105) designed to emit an emission current (134), a phosphor (126) disposed to receive at an electron-receiving surface (127) emission current (134), and a multi-layered barrier structure (125) disposed on electron-receiving surface (127) of phosphor (126). Multi-layered barrier structure (125) of the preferred embodiment includes an aluminum layer (128) disposed on electron-receiving surface (127) of phosphor (126) and a carbon layer (129) disposed on aluminum layer (128).

20 Claims, 1 Drawing Sheet

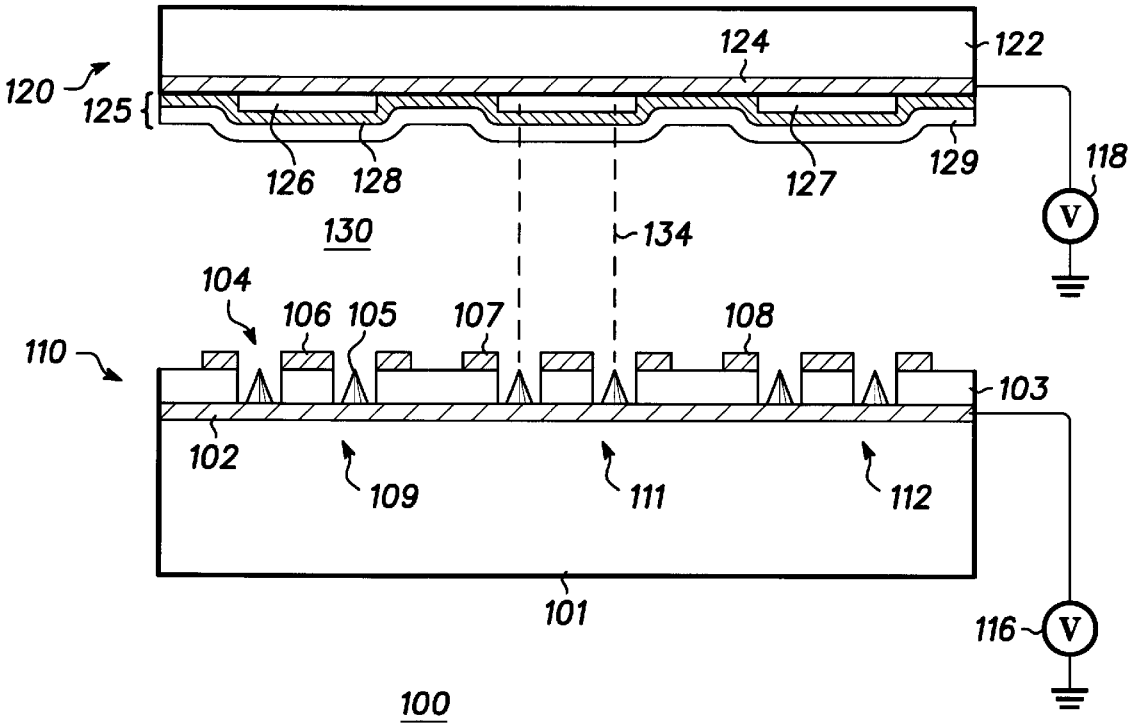
124
122
120
125
126
128
127
129
118
V
130
134
104
106
105
107
108
110
103
102
109
111
112
101
116
V
100

FIELD EMISSION DISPLAY HAVING A MULTI-LAYERED BARRIER STRUCTURE

FIELD OF THE INVENTION

The present invention relates, in general, to field emission displays, and, more particularly, to anode plates for high voltage field emission displays.

BACKGROUND OF THE INVENTION

Field emission displays (FED's) are known in the art. High voltage FED's are operated at anode voltages that are greater than about 1000 volts. A typical high voltage anode plate includes a transparent substrate upon which is formed an anode, which typically is made from indium tin oxide. The cathodoluminescent phosphors are disposed on the anode.

It is also know to provide an aluminum layer on the cathodoluminescent phosphors in order to improve brightness. The aluminum layer improves the brightness of the display image by reflecting the light that is initially directed away from the viewer.

However, aluminum oxide ($Al_2O_3$), which is known to exist at the outer surface of the aluminum layer, readily forms hydrates. The water from the hydrates can be liberated into the vacuum of the FED when the aluminum layer is struck by the electron beams. Furthermore, it is known that aluminum oxide can be decomposed by electron bombardment, thereby evolving oxygen into the vacuum of the FED. It is known that the presence of water and oxygen are undesirable because they can react with the electron emitter structures, thereby contaminating them and causing deterioration of their emissive properties.

It is also known that adding layers to the electron-receiving surfaces of the cathodoluminescent phosphors has the undesirable effect of lowering the energy of the electrons. This problem is more pronounced in low voltage FED's because the electrons are much less energetic when they arrive at the anode plate, as contrasted with high voltage FED's. Thus, it is known in the art that the addition of layers at the electron-receiving side of the cathodoluminescent phosphors can be undesirable.

Accordingly, there exists a need for a field emission display, which overcomes at least these shortcomings of the prior art.

BRIEF DESCRIPTION OF THE DRAWING

The sole FIGURE is a cross-sectional view of a field emission display, in accordance with a preferred embodiment of the invention.

It will be appreciated that for simplicity and clarity of illustration, elements shown in the drawings have not necessarily been drawn to scale. For example, the dimensions of some of the elements are exaggerated relative to each other.

DESCRIPTION OF THE PREFERRED EMBODIMENTS

The invention is for a field emission display (FED) having a multi-layered barrier structure. In accordance with the invention, the multi-layered barrier structure is formed on the electron-receiving surfaces of the phosphors. The multi-layered barrier structure has at least a first layer and a protective layer. The first layer is preferably made from a material that is reflective of light, such as aluminum. The protective layer is preferably made from carbon. The protective layer of the invention is useful for reducing the level of contaminants within the vacuum of the FED. It is believed that the protective layer reduces the level of contaminants by preventing the transmission of contaminants, such as $H_2O$ and $O_2$, through the protective layer and into the vacuum of the FED. It is believed the protective layer can also improve levels of contamination by reacting with and/or adsorbing contaminants. In this manner, the multi-layered barrier structure improves the lifetime of the FED.

The sole FIGURE is a cross-sectional view of a field emission display (FED) 100, in accordance with a preferred embodiment of the invention. FED 100 includes a cathode plate 110 and an anode plate 120. Anode plate 120 is spaced apart from cathode plate 110 to define an interspace region 130 therebetween. The separation distance between cathode plate 110 and anode plate 120 is preferably about 1 millimeter.

Cathode plate 110 includes a substrate 101, which can be made from glass, silicon, and the like. A cathode 102 is disposed upon substrate 101. Cathode 102 is connected to a first independently controlled voltage source 116. A dielectric layer 103 is disposed upon cathode 102 and further defines a plurality of emitter wells 104.

An electron emitter structure 105, such as a Spindt tip, is disposed in each of emitter wells 104. Electron emitter structures 105 are the electron-emissive structures of cathode plate 110, which are useful for generating the display image.

A first gate extraction electrode 106 is disposed on dielectric layer 103. At the location of the overlap of first gate extraction electrode 106 with cathode 102 is defined a first sub-pixel 109. Similarly, at the location of the overlap of a second gate extraction electrode 107 and a third gate extraction electrode 108 with cathode 102 are defined a second sub-pixel 111 and a third sub-pixel 112, respectively. Each sub-pixel is useful for causing one of a plurality of phosphors 126 to emit light. Gate extraction electrodes 106, 107, and 108 are connected to a second independently controlled voltage source (not shown). Methods for fabricating cathode plates for matrix-addressable FED's are known to one of ordinary skill in the art.

Anode plate 120 is disposed to receive a plurality of emission currents 134 emitted by electron emitter structures 105. Anode plate 120 includes a transparent substrate 122, which is made from a hard, transparent material, such as, for example, soda lime glass. An anode 124 is disposed upon transparent substrate 122. Anode 124 is made from a transparent, conductive material, such as indium tin oxide. Anode 124 is connected to a third independently controlled voltage source 118. Phosphors 126 are disposed on anode 124. Each of phosphors 126 defines an electron-receiving surface 127. The electrons of emission current 134 strike phosphor 126 at electron-receiving surface 127.

In accordance with the invention, anode plate 120 further has a multi-layered barrier structure 125. Multi-layered barrier structure 125 is disposed on electron-receiving surfaces 127 of phosphors 126.

The multi-layered barrier structure of the invention has at least a first layer and a protective layer. In general, the protective layer is useful for preventing transmission of one or more contaminants from the anode plate, through the protective layer, and into the interspace region of the FED. The protective layer can function as a barrier to contaminants, such as $H_2O$, $O_2$, CO, $N_2$, and $CO_2$. Preferably, the protective layer is made from a material selected to substantially prevent transmission of a contaminant through the protective layer. By substantial prevention it is meant that the transmission of the contaminant(s) is reduced by an extent sufficient to cause an improvement in the life of the FED, as contrasted with a display, which differs from the FED only in that the protective layer is omitted.

Preferably, the protective layer is made from a material characterized by a low atomic number (low-Z material), so that the protective layer does not substantially compromise the ability of electrons to pass through the protective layer and strike the phosphors with the intended energy. The protective layer can also be made from a material characterized by a high atomic number. In this instance, the thickness of the protective layer is selected to be thin enough to ameliorate degradation of the electron transmission.

The density of the protective layer is a further parameter that can be selected, so that the protective layer does not substantially compromise the ability of electrons to pass through the protective layer and strike the phosphors with the intended energy. In general, a lower density is preferred over a higher density. The protective layer is also preferably sufficiently conductive to prevent charge build up, is stable in high vacuum conditions, and is stable upon bombardment with electrons.

The protective layer is preferably made from a material selected from the group consisting of silicon, silicon carbide, aluminum nitride, magnesium oxide, boron carbide, aluminum carbide, beryllium carbide, carbon, titanium, titanium dioxide, platinum, gold, palladium, titanium nitride, and tantalum nitride. Most preferably, the protective layer is made from a low-Z material selected from the group consisting of silicon, silicon carbide, aluminum nitride, magnesium oxide, boron carbide, aluminum carbide, beryllium carbide, and carbon.

Preferably, the protective layer is amorphous. For example, the protective layer can be made from amorphous titanium nitride or amorphous tantalum nitride. The amorphous material provides an effective diffusion barrier because it lacks the grain boundaries and crystal defects through which gases easily migrate.

Preferably, the first layer is distinct from the protective layer with respect to the function performed and/or the material. Furthermore, the first layer can be separated from the protective layer by one or more distinct layers. Preferably, the first layer is reflective of light. Most preferably, the first layer is made from a material selected from the group consisting of aluminum, gold, titanium, platinum, and palladium.

The invention is further embodied by a FED having a multi-layered barrier structure that has one or more layers in addition to the first layer and protective layer. The additional layer(s) is/are distinct with respect to function and/or material from layers adjacent thereto.

In the preferred embodiment of the sole FIGURE, multi-layered barrier structure 125 has an aluminum layer 128, and a carbon layer 129. Aluminum layer 128 is made from aluminum and preferably has a thickness equal to about 500 angstroms. Aluminum layer 128 is disposed on electron-receiving surfaces 127 of phosphors 126 and is useful for reflecting light toward the viewer of the display image.

Carbon layer 129 is disposed on aluminum layer 128 and is made from carbon. Preferably, carbon layer 129 is a layer of $sp^3$-bonded carbon. Carbon layer 129 is also preferably amorphous. The thickness of carbon layer 129 is selected to substantially prevent transmission of at least one contaminant, such as $H_2O$, $O_2$, CO, $N_2$, and $CO_2$, therethrough. Preferably, the thickness of carbon layer 129 is equal to about 10–200 angstroms. Most preferably, the thickness of carbon layer 129 is equal to about 100 angstroms.

FED 100 is operated by applying potentials to gate extraction electrodes 106, 107, and 108, and to cathode 102 for causing selective emission of electrons from electron emitter structures 105. A potential is also applied to anode 124 for attracting the electrons thereto. The electrons traverse multi-layered barrier structure 125 and activate phosphors 126 with sufficient energy to produce a useful level of brightness.

Methods for depositing phosphors for FED's are known to one of ordinary skill in the art. Anode plate 120 is fabricated by depositing on phosphors 126 a layer of aluminum using a convenient deposition method. Thereafter, carbon is deposited on aluminum layer 128 using, for example, plasma enhanced chemical vapor deposition techniques.

In summary, the invention is for a field emission display (FED) having an anode plate, which has a multi-layered barrier structure. The FED of the invention reduces outgassing from the anode plate into the evacuated region of the device. In this manner, the FED of the invention has less contamination of the electron emitter structures, as contrasted with a high voltage FED of the prior art.

While we have shown and described specific embodiments of the present invention, further modifications and improvements will occur to those skilled in the art. For example, the invention is embodied by a FED that has an additional layer sandwiched between the first layer and the protective layer. For example, the invention is embodied by a FED having a multi-layered barrier structure that has a carbon layer disposed on the phosphor, a reflective layer disposed on the carbon layer, and a protective layer disposed on the reflective layer. The invention is further embodied by a FED that has an additional layer disposed on the protective layer. For example, the additional layer can be a conductive layer, which improves the conductivity of the multi-layered barrier structure.

We desire it to be understood, therefore, that this invention is not limited to the particular forms shown, and we intend in the appended claims to cover all modifications that do not depart from the spirit and scope of this invention.

We claim:

1. A field emission display comprising:

an electron emitter structure designed to emit an emission current;

a phosphor having an electron-receiving surface and disposed to receive at the electron-receiving surface the emission current; and a multi-layered barrier structure disposed on the electron-receiving surface of the phosphor and having a first layer and a protective layer comprised of amorphous carbon.

2. The field emission display as claimed in claim 1, wherein the protective layer comprises a material selected to substantially prevent transmission of a contaminant through the protective layer.

3. The field emission display as claimed in claim 2, wherein the contaminant is a species selected from the group consisting of $H_2O$, $O_2$, CO, $N_2$, and $CO_2$.

4. The field emission display as claimed in claim 1, wherein the protective layer includes $sp^3$-bonded amorphous carbon.

5. The field emission display as claimed in claim 1, wherein the first layer is reflective of light.

6. The field emission display as claimed in claim 5, wherein the first layer is made from a material selected from the group consisting of aluminum, gold, titanium, platinum, and palladium.

7. The field emission display as claimed in claim 6, wherein the first layer is made from aluminum and has a thickness equal to about 500 angstroms.

8. The field emission display as claimed in claim 1, wherein the first layer is disposed on the electron-receiving surface of the phosphor.

9. The field emission display as claimed in claim 1, wherein the protective layer is disposed on the first layer.

10. The field emission display as claimed in claim 1, wherein the protective layer has a thickness, and wherein the thickness of the protective layer is selected to substantially prevent transmission of a contaminant through the protective layer.

11. The field emission display as claimed in claim 10, wherein the contaminant is a species selected from the group consisting of $H_2O$, $O_2$, CO, $N_2$, and $CO_2$.

12. The field emission display as claimed in claim 10, wherein the thickness of the protective layer is within a range of 10–200 angstroms.

13. The field emission display as claimed in claim 12, wherein the thickness of the protective layer is equal to 100 angstroms.

14. A field emission display comprising:

an electron emitter structure designed to emit an emission current;

a phosphor having an electron-receiving surface and disposed to receive at the electron-receiving surface the emission current;

an aluminum layer disposed on the electron-receiving surface of the phosphor; and an amorphous carbon layer disposed on the aluminum layer.

15. The field emission display as claimed in claim 14, wherein the amorphous carbon layer comprises $sp^3$-bonded amorphous carbon.

16. The field emission display as claimed in claim 14, wherein the aluminum layer has a thickness equal to about 500 angstroms.

17. The field emission display as claimed in claim 14 wherein the amorphous carbon layer has a thickness, and wherein the thickness of the amorphous carbon layer is selected to substantially prevent transmission of a contaminant through the amorphous carbon layer.

18. The field emission display as claimed in claim 17, wherein the contaminant is a species selected from the group consisting of $H_2O$, $O_2$, CO, $N_2$, and $CO_2$.

19. The field emission display as claimed in claim 14, wherein the thickness of the amorphous carbon layer is within a range of 10–200 angstroms.

20. The field emission display as claimed in claim 19, wherein the thickness of the amorphous carbon layer is equal to 100 angstroms.

* * * * *